US007418760B2

(12) United States Patent
Birnbaum

(10) Patent No.: US 7,418,760 B2
(45) Date of Patent: Sep. 2, 2008

(54) MULTI-FUNCTIONAL HAND-HELD TOOL

(76) Inventor: Betty Birnbaum, P.O. Box 55, Southampton, NY (US) 11969

( * ) Notice: Subject to any disclaimer, the term of this patent is extended or adjusted under 35 U.S.C. 154(b) by 237 days.

(21) Appl. No.: 10/634,445

(22) Filed: Aug. 5, 2003

(65) Prior Publication Data

US 2005/0028311 A1 Feb. 10, 2005

(51) Int. Cl.
*A47L 13/08* (2006.01)
*A47L 13/02* (2006.01)
*A47L 17/06* (2006.01)

(52) U.S. Cl. ..... 15/236.07; 15/236.08; D8/105; D32/46

(58) Field of Classification Search ..... 30/169; 15/236.01, 236.05, 236.07, 236.08, 245.1; D8/45, 105; D32/46
See application file for complete search history.

(56) References Cited

U.S. PATENT DOCUMENTS

| | | | | | |
|---|---|---|---|---|---|
| 614,810 | A * | 11/1898 | Houghton | 30/169 |
| 1,192,910 | A * | 8/1916 | Lawrence | 30/169 |
| 1,211,098 | A * | 1/1917 | Darrin | 15/236.05 |
| 1,388,282 | A * | 8/1921 | Meredith | 15/245 |
| 1,538,521 | A * | 5/1925 | Sheridan | 30/169 |
| 3,178,747 | A * | 4/1965 | Peterson | 15/236.01 |
| 3,256,548 | A * | 6/1966 | Peterson | 15/236.01 |
| 4,549,611 | A * | 10/1985 | Mills | 172/375 |
| 4,558,517 | A * | 12/1985 | Gringer | 30/169 |
| 4,747,175 | A * | 5/1988 | Durgin | 15/105 |
| 5,092,050 | A * | 3/1992 | Bardeen | 30/324 |
| D402,514 | S * | 12/1998 | Killins | D8/16 |
| 2003/0200619 | A1 * | 10/2003 | Kelsey et al. | 15/236.01 |

* cited by examiner

*Primary Examiner*—Laura C Guidotti
(74) *Attorney, Agent, or Firm*—Cowan, Liebowitz & Latman, PC

(57) ABSTRACT

A multi-functional tool for use on flat or curved surfaces, comprising a flexible hand-held member characterized by a plurality of undulations formed in the member and having a plurality of edges and surfaces.

11 Claims, 11 Drawing Sheets

MULTI-FUNCTIONAL HAND-HELD TOOL

BACKGROUND OF THE INVENTION

This invention relates to hand held tools and, in particular, to a flexible cleaning tool having a plurality of edges and ridges which accommodate the user's hand and fingers and enable the tool to perform a variety of functions.

Hand-held tools for cleaning or scraping generally include a member and an attached or integral handle. Hand-held scrapers with handles or grips formed integrally therein are highly effective for scraping surfaces to clean or remove materials because pressure is directly applied by the user's hand to the surface being scraped with the scraping member of the tool. A hand-held tool that accommodates the shape of the user's hand is desirable because it improves the user's grip and is comfortable to use.

Such scrapers and cleaners are available in a variety of configurations and materials to be used for indoor and outdoor tasks such as: removing snow, ice and frost from an automobile windshield (U.S. Pat. No. 4,747,175); removing paint or other materials from a glass surface (U.S. Pat. No. 4,558,517); scooping soft materials (U.S. Pat. No. 5,092,050); and cleaning gutters of various shapes or performing light gardening tasks (U.S. Pat. No. 4,549,611). As is evident from these examples, hand held tools in the prior art that may be used to scrape or clean surfaces are commonly formed from rigid materials for strength and durability and are therefore particularly suited for only a limited number of applications. In addition, the flat design of the scraping member of such tools further limits the surfaces with which the tools may be used.

It is therefore an object of the present invention to provide a hand held cleaning tool that is flexible to accommodate a variety of functions while maintaining its resilient, strong construction.

It is a further object of the present invention to provide a hand held cleaning tool that is inexpensive and easy to manufacture.

It is yet another object of the invention to provide a hand-held cleaning tool comprising a flexible member with undulations which contribute to the flexibility of the tool and also enable the tool to accommodate both flat and rounded surfaces.

SUMMARY OF THE INVENTION

In accordance with the principles of the present invention, the above and other objectives are realized in a multi-functional hand held tool including a flexible member. Particularly, the invention is directed to an improved device for cleaning or scraping flat or curved surfaces that is particularly suited for cleaning or performing household tasks in corners, narrow areas and other hard-to-reach surfaces. The device is constructed of a single piece of durable, flexible material that is easily molded and inexpensive to mass produce, such as PVC plastic. The tool forms a member that is characterized by undulations and a plurality of different edges and surfaces for performing various different household tasks with ease and comfort.

Common indoor and outdoor tasks that may be achieved by the tool of the present invention include cleaning, scraping and scrubbing surfaces such as glass, plastic, metal, wood, porcelain, cloth, marble, corian, formica, and ceramic tile, with or without cleaning agents and without marring, scratching or otherwise damaging such surfaces. The tool is further adapted for such tasks as, for example, removing stickers, tape, chewing gum and other adhesive materials; cleaning grime and grease on countertops or other surfaces; removing paint, ink and grease from surfaces and from skin; removing or applying glue and other kinds of adhesive; removing lint from clothing; scraping off mold and mildew; cleaning combs and brushes; scraping and removing candle wax; removing burnt food from pots or other cooking utensils or surfaces; removing stains on clothing (with appropriate detergent); removing soap residue from tiles or other surfaces, and cleaning jewelry. The tool may further be used for graphic arts tasks such as pasting and gluing, e.g., gluing mattes around pictures, and in other similar arts and crafts projects. One embodiment of the tool is particularly suited for use with wallpaper, such as for spreading adhesive on wallpaper and smoothing it against a wall, gluing wallpaper edges at comers and along seams, repairing ripped seams, or for removing wallpaper from a wall.

BRIEF DESCRIPTION OF THE DRAWINGS

The above and other features and aspects of the present invention will become more apparent upon reading the following detailed description in conjunction with the accompanying drawings, in which.

DETAILED DESCRIPTION OF THE INVENTION

FIGS. 1-6 show a hand-held tool in accordance with the present invention. As shown in FIGS. 1-6, the tool comprises a member 10 with a plurality of edges. The member 10 also has repeating waves or undulations 21 that extend from one edge 16 to an opposite edge 18. The undulations 21 in the member 10 form peak regions 21A and valley regions 21B and impart flexibility to the tool which, combined with the different shapes and properties of the edges of the member, makes the tool comfortable to use and suitable for many various household cleaning and scraping tasks.

Figure 1:
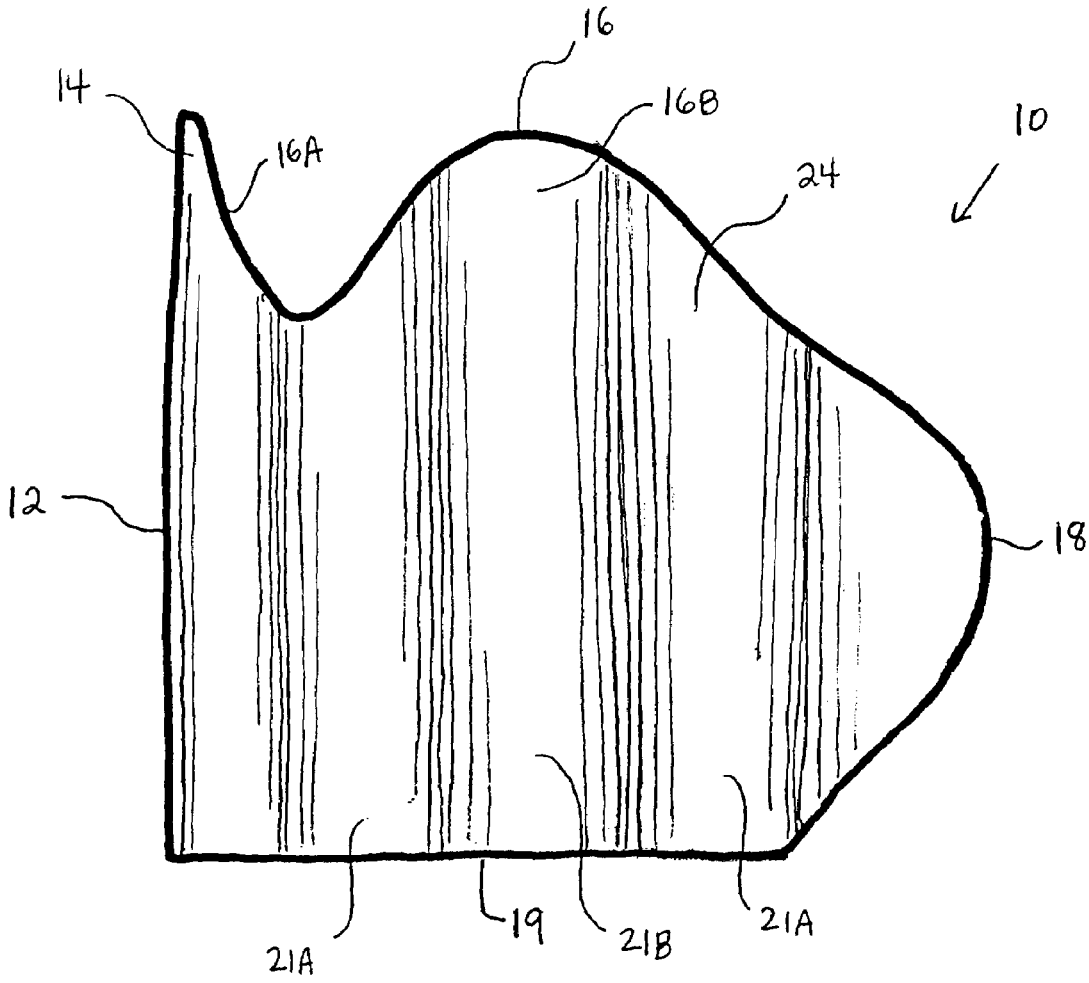
FIG. 1 is a top view of the hand-held tool in accordance with the present invention.

FIG. 1 is a top view of one embodiment of the hand-held tool. As shown, the tool comprises a member 10 having various scraping and cleaning edges. A straight scraping edge 12 is disposed along one side of the member 10. The straight edge 12 may be used for scraping or scooping material from a flat surface, depending on whether the member is oriented right side up or upside-down, as explained in further detail below.

One end of the straight edge 12 terminates in a sharp tip 14 formed by the intersection of the straight edge 12 and a rounded cleaning edge 16. The rounded cleaning edge 16 is generally S-shaped, with one end 16A of the "S" forming the tip 14 at its intersection with one end of the straight edge 12. The angle of the tip 14 and its position on the member with respect to other features of the member 10 make it ideal for such uses as applying or removing glue or other substances from small spaces, cutting paper or other similar material, cleaning jewelry, removing plastic wrap, and cutting plastic shrink wrap such as on compact disks, videotapes, and the like.

The S-shaped cleaning edge 16 also defines a rounded region 16B that functions as a strong, flexible "fingernail" and is particularly suited for cleaning or scraping surfaces that may not be flat, or along rounded surface edges such as, for example, the inside surface of a saucepan or pot. The end of the rounded cleaning edge 16 opposite the sharp tip 14 forms one end of a rounded scraping edge 18. Like the straight edge 12 on the opposite side of the member, rounded scraping edge 18 may be used alternately for scooping or scraping surfaces, depending on the orientation of the member. Like the S-shaped cleaning edge or fingernail 16, the rounded scraping edge 18 may be used with round surfaces and along rounded edges of surfaces. As will be described further below with respect to FIG. 6, the rounded scraping edge 18 may be sharpened to serve as a wider "fingernail" edge or rounded blade.

A further edge 19 is disposed on a side of the member 10 opposite the S-shaped rounded cleaning edge 16, connecting one end of the flat scraping edge 12 with one end of the rounded scraping edge 18, as shown. As will be described further below, due to the curvature of the member 10 at the further edge 19, such edge is suitable for scrubbing an uneven surface and may be further modified with teeth for scrubbing adhesive materials from such a surface.

Figure 2:
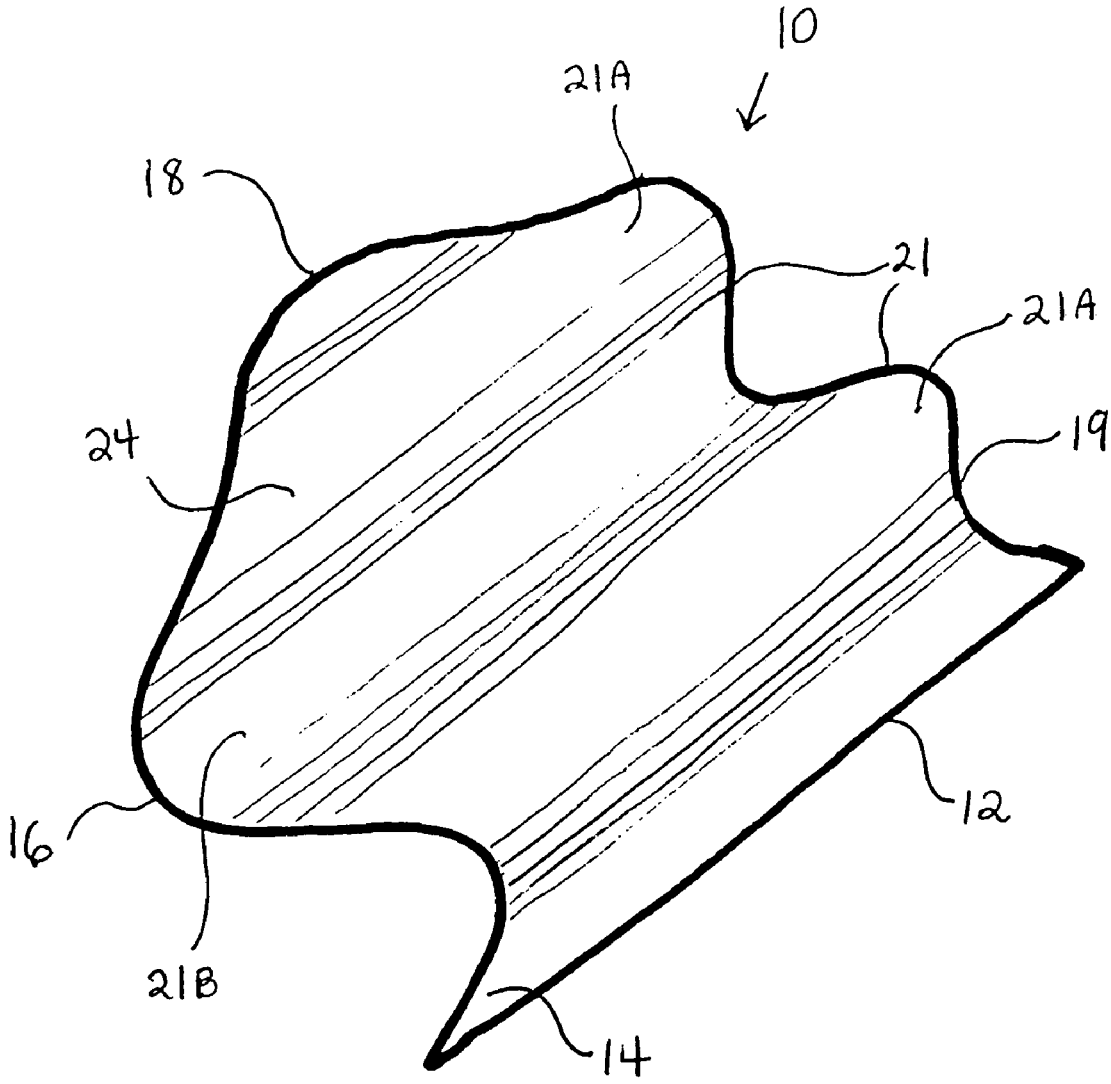
FIG. 2 is a perspective view thereof.

The various edges of the member 10 are also shown in FIG. 2, which is a perspective view of the hand-held tool of FIG. 1. In the illustrative embodiment, the undulations 21 formed in the tool member 10 are parallel to the length of the flat scraping edge 12 at one side of the member, continue through the member 10 and terminate at the rounded scraping edge 18. As shown, the curved shaped of both the rounded edge 16 and the further scrubbing edge 19 is defined by the undulations 21 formed in the member 10. Particularly, a portion of an undulation 21 forms the fingernail-like shape of the rounded cleaning edge 16 which enables the edge 16 to be used for cleaning rounded or irregularly shaped surfaces as described above. Similarly, the curvature of the scrubbing edge 19 on the opposite side of the member 10 makes this edge suitable for use on irregularly shaped or uneven surfaces.

An additional advantage of undulations 21 formed in the member 10 of the hand-held tool is that the curved design of the member 10 accommodates the fingers of a user, making the tool more comfortable to use and more effective, because pressure may be directly applied from the user through his hand to the tool and to the corresponding surface being cleaned or scraped. These advantages of undulations 21 formed in the member 10 are particularly effective with respect to the sharp tip 14, rounded cleaning edge 16 and scrubbing edge 19, insofar as the user moves the tool in a direction generally parallel to the direction in which his fingers are placed in the undulations of the member 10.

Yet another advantage of the undulations 21 formed in the member 10 is that the curvature of the member itself imparts flexibility to the member, particularly in a direction perpendicular to the length of the undulations 21. For example, when a user holds the tool shown in FIG. 2 such that either the rounded scraping edge 18 or the flat scraping edge 12 is to be used, pressure applied by the user's hand against the tool at a distance from the rounded edge 18 or from the flat scraping edge 12 causes the undulations 21 to flex, whereby the rounded scraping edge 18 or flat scraping edge 12 is flexible and accommodates variations in the shape or curvature of the surface being cleaned. Similarly, the sharp tip 14 can accommodate narrow or hard-to-reach areas due to the flexibility of the member 10 in that the user can selectively apply pressure to the member 10 with his hand placed in its undulations 21, thereby controlling the tip 14 by causing the member 10 to flex.

Figure 3:
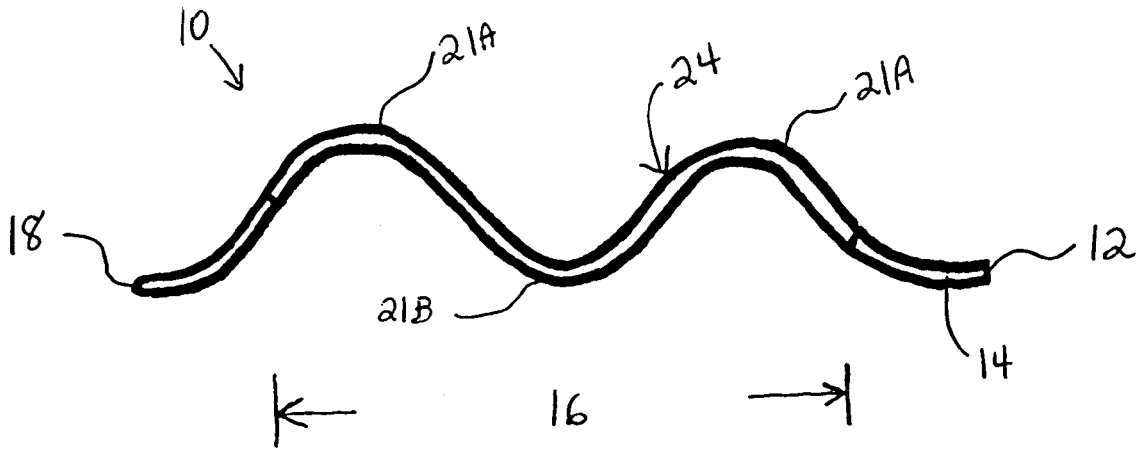
FIG. 3 is a front view thereof.

The sinuosity of the member 10 is also shown in the front view of the invention in FIG. 3. As can be seen in this view, undulations 21 continue from the flat scraping edge 12 to the rounded scraping edge 18 on the opposite side of the member 10. The undulations 21 define the "fingernail" shape of the rounded cleaning edge 16 and, as described above, add significant flexibility to the edges 12, 18 as well as to the sharp tip 14. It is contemplated that the thickness of the member 10 may vary such that, for example, the lower or valley portions 21B of the undulations are thicker than the upper or peak portions 21A. In such a configuration, the rounded cleaning edge 16, sharp tip 14, flat scraping edge 12 and rounded scraping edge 18 would each be more durable without sacrificing flexibility of the member 10.

Figure 4:
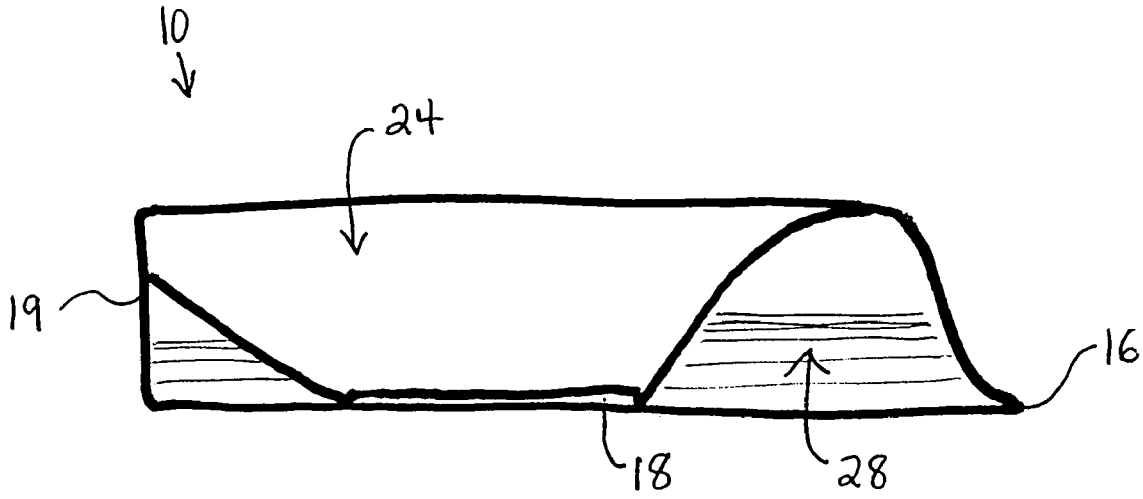
FIG. 4 is a left side view thereof.
Figure 5:
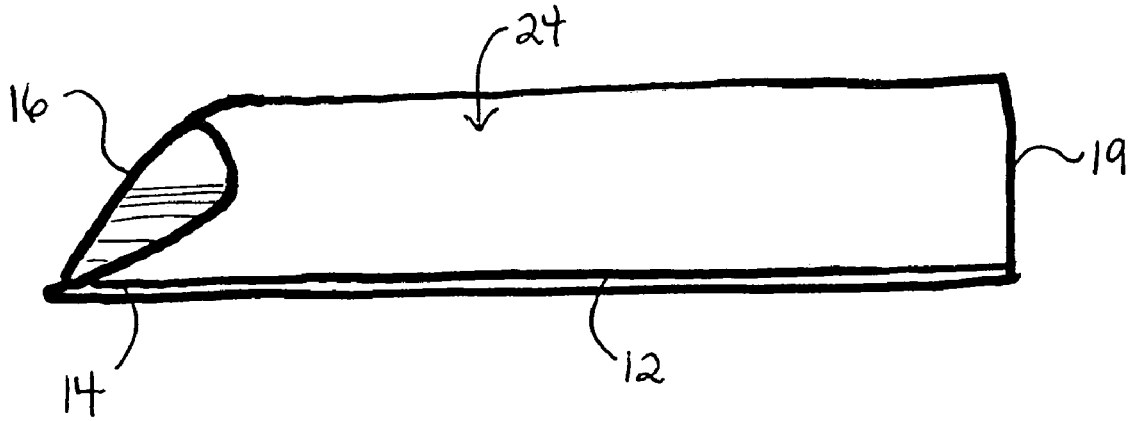
FIG. 5 is a right side view thereof.

FIGS. 4 and 5 show the left and right side views, respectively, of the hand tool of the present invention. In FIG. 4, the member 10 of the tool is oriented right-side up and comprises an upper surface 24 and lower surface 28. As can be seen in this view, the undulations 21 formed in the member 10 give the rounded scraping edge 18 a slight upward turn, which makes such edge suitable for scooping up materials from the surface being scraped and is particularly well-suited for scooping from rounded surfaces. When the member 10 is turned over so that the upper surface 24 is oriented below the lower surface 28 of the member 10 with respect to the surface being scraped, the rounded scraping edge 18 may be more efficiently used as a scraper, with the rounded scraper edge 18 having a slight downward turn.

The member 10 is also shown right-side up in FIG. 5, which is a right side view of the tool showing the flat scraping edge 12 and sharp tip 14. As with the rounded scraping edge 18 shown in FIG. 4, the undulations 21 formed in the member give the flat scraping edge a slightly upward turn, making it suitable as a scooper. Unlike the rounded scraping edge 18, however, the flat scraping edge 12 is suitable for scooping up materials from a flat surface when the member is positioned as shown in FIG. 5. When the member 10 is upside-down, so that the upper surface 24 of the member is closest to the surface being scraped, the flat scraping edge 12 is an efficient scraper for use on flat surfaces, its edge turned slightly downward as a result of the undulations 21 in the member.

It is understood that the member 10 may be formed so that the slight curvature upward or downward of the rounded edge 18 or of the flat edge 12 may be more or less pronounced, or alternatively, so that one or both of the end of the rounded edge 18 and the flat edge 12 are without any curvature.

The sharp tip 14 as shown in FIG. 5 is effective for use in at least the household functions described above regardless of the orientation of the member 10 with respect to the object or surface on which the tool is used.

Figure 6:
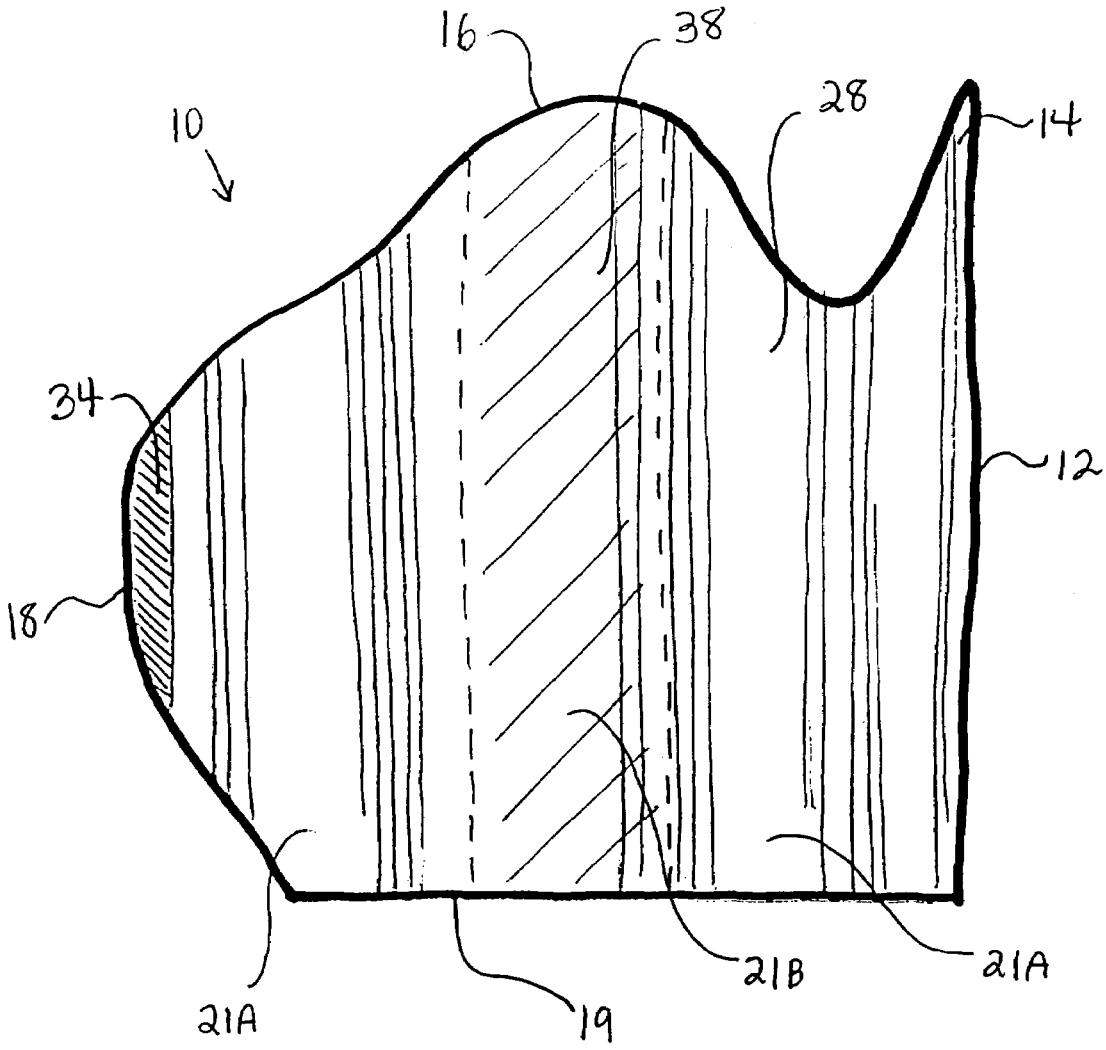
FIG. 6 is a bottom view thereof.

FIG. 6 is a bottom view of the member 10 of the present invention. As shown in this view, the lower surface 28 of the illustrative embodiment of the tool has been roughened in a region 38 defined by a strip extending from the rounded cleaning edge or fingernail 16 to the scrubbing edge 19 of the member, along the undulation 21B corresponding thereto. Thus, when a user's hand is placed on the upper surface 24 of the member 10 such that the user's fingers are positioned between undulations 21, and either the rounded fingernail edge 16 or the scrubbing edge 19 is being used, the roughened surface region 38 acts to enhance the surface scraping and scrubbing ability of the tool. It is to be understood that all or other regions of the lower surface 28 may be similarly roughened, and that in addition, or alternatively, the upper surface 24 or regions thereof may be roughened as well.

Also shown in FIG. 6 is the rounded scraper edge 18. This edge may be sharpened, so that the edge functions as a blade 34 for cutting and scraping adhesive materials from rounded or flat surfaces.

Figure 7:
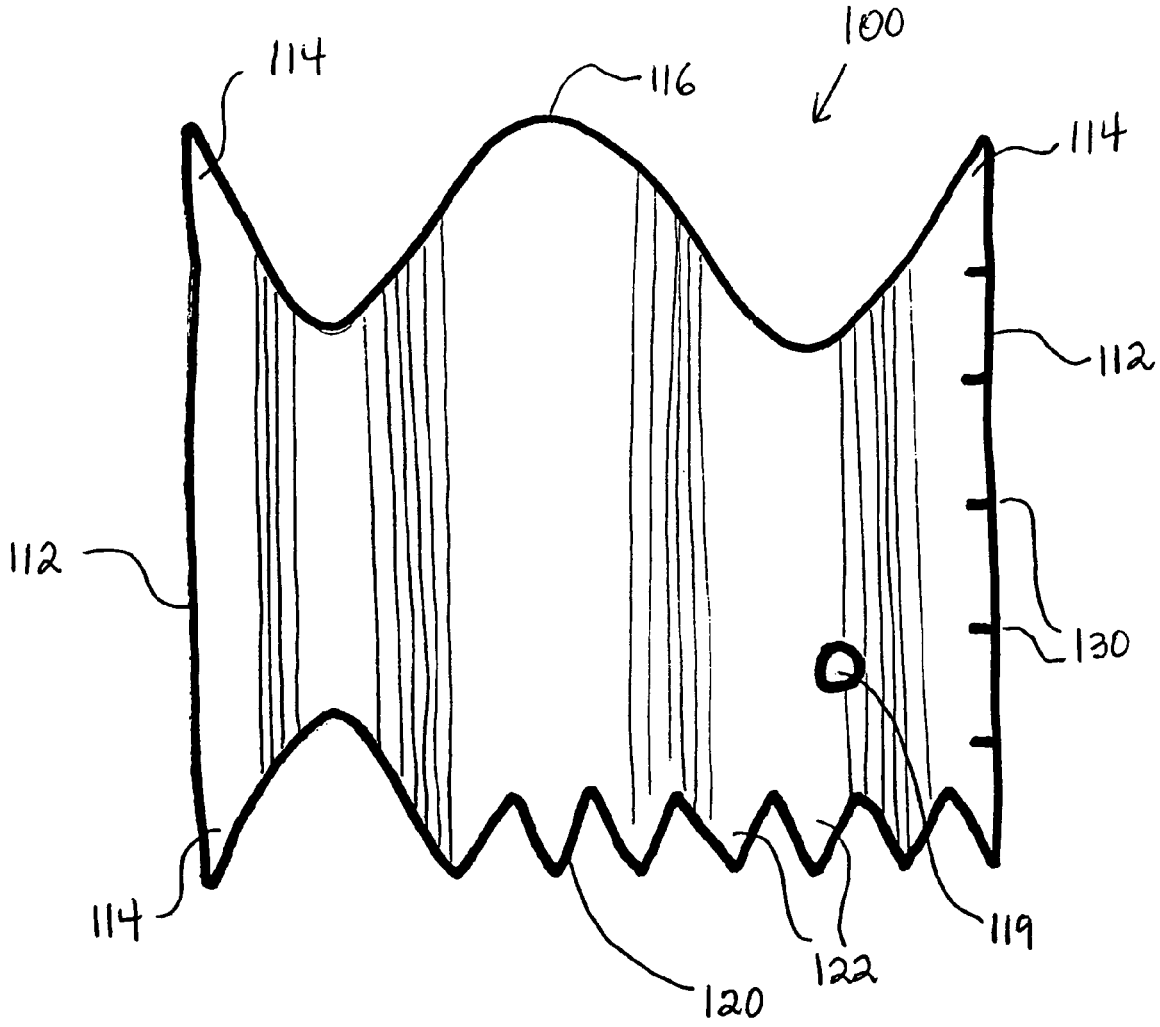
FIG. 7 is a top view of an alternate embodiment of the hand-held tool in accordance with the present invention.

A second embodiment of the invention is shown in FIG. 7. In this embodiment, the tool member 100 is formed with two straight edges 112 on opposite sides of the member, each of which forms a sharp tip 114 at the intersection of one end of each edge 112 With a rounded W-shaped edge 116. A wallpaper scraping edge 120 opposite the rounded W-shaped edge 116 in the illustrative embodiment also comprises a sharp tip 114 as well as an adjacent series of teeth 122. In an alternative embodiment, teeth 122 may extend along the entire wallpaper scraping edge 120, from one end of one straight edge 112 to one end of the opposite straight edge 112.

Figure 8:
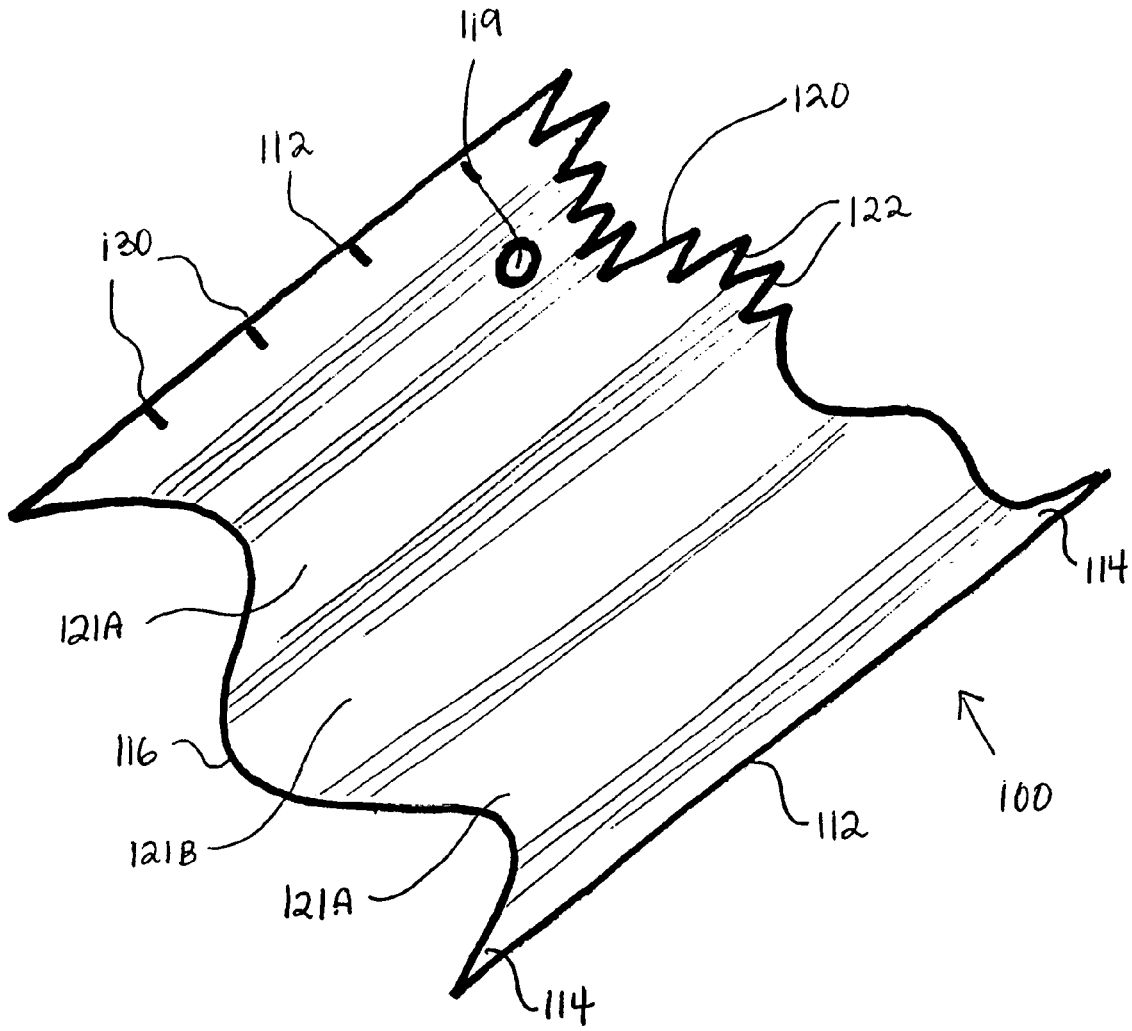
FIG. 8 is a perspective view thereof.

FIG. 8 is a perspective view of the second embodiment of the tool shown in FIG. 7. As shown in this view, undulations 121 formed in the member 100 are parallel to straight scraping edges 112 and extend between the rounded "fingernail" edge 116 and the wallpaper scraping edge 120. The undulations 121 in the member 10 form peak regions 121A and valley regions 121B and impart flexibility to the tool. Although not shown in this view, the lower surface 128 of this embodiment may also have such features as a region of roughened surface along an undulation 121B similar to the roughened region 38 of the lower surface 28 of the first embodiment shown in FIG. 6. In addition, one of straight edges 112 may be sharpened to form a blade for a sharper edge for applying sheets of wallpaper, for example.

The features of the tool in the second embodiment as shown in FIGS. 7 and 8 illustrate how the tool in accordance with the present invention may be easily formed for a specific purpose, namely, applying and smoothing down or scraping and removing wallpaper. Specifically, each straight scraping edge 112 may be used as a lifter or smoother for either removing or smoothing down sheets of wallpaper, depending on the orientation of the member 100 with respect to the wallpapered surface. The slight curvature of the edges 112, like the curvature of the flat scraping edge 12 in the first embodiment described above, is defined by undulations 121 in the member 100. In addition, as shown in FIG. 7, one of the straight edges 112 may have hatch marks 130 adjacent thereto for measuring or marking the surface with which the tool is being used.

The rounded "W" edge 116, like the "S" shaped edge 16 of the first embodiment described above, has a similar "fingernail" functionality, having a shape defined by the curved edge and the sinuosity of the member 100. The teeth 122 in the wallpaper scraping edge 120 opposite the rounded "fingernail" edge 116, combined with the flexibility of the member 100 imparted by undulations 121, are effective for scraping away wallpaper or other adhesive material from a wall or other surface. The sharp tips 114 formed on three corners of the member 100, or on two corners in the alternative embodiment in which teeth 122 extend along the entire wallpaper scraping surface 120, may be used for tasks including applying or removing wallpaper close to the corners or edges of walls, smoothing the edge of a sheet of wallpaper in a corner or on an edge or in other tight or hard-to-reach spaces, or applying small amounts of adhesive such as glue to comers or edges of walls or other hard-to-reach areas. Finally, a hole 119 may be formed in the member 100 for threading a rope, cord or other fiber through to serve as a handle for the tool. The handle may also be made from materials such as, for example, rubber, plastic, or similar inexpensive and durable material.

As described above with respect to several embodiments of the tool of the present invention, the member dimensions and shapes may be varied to accomplish any of a wide variety of household tasks. One variation in the dimensions of the tool is shown in a third embodiment of the invention, which is depicted in FIGS. 9 and 10.

Figure 9:
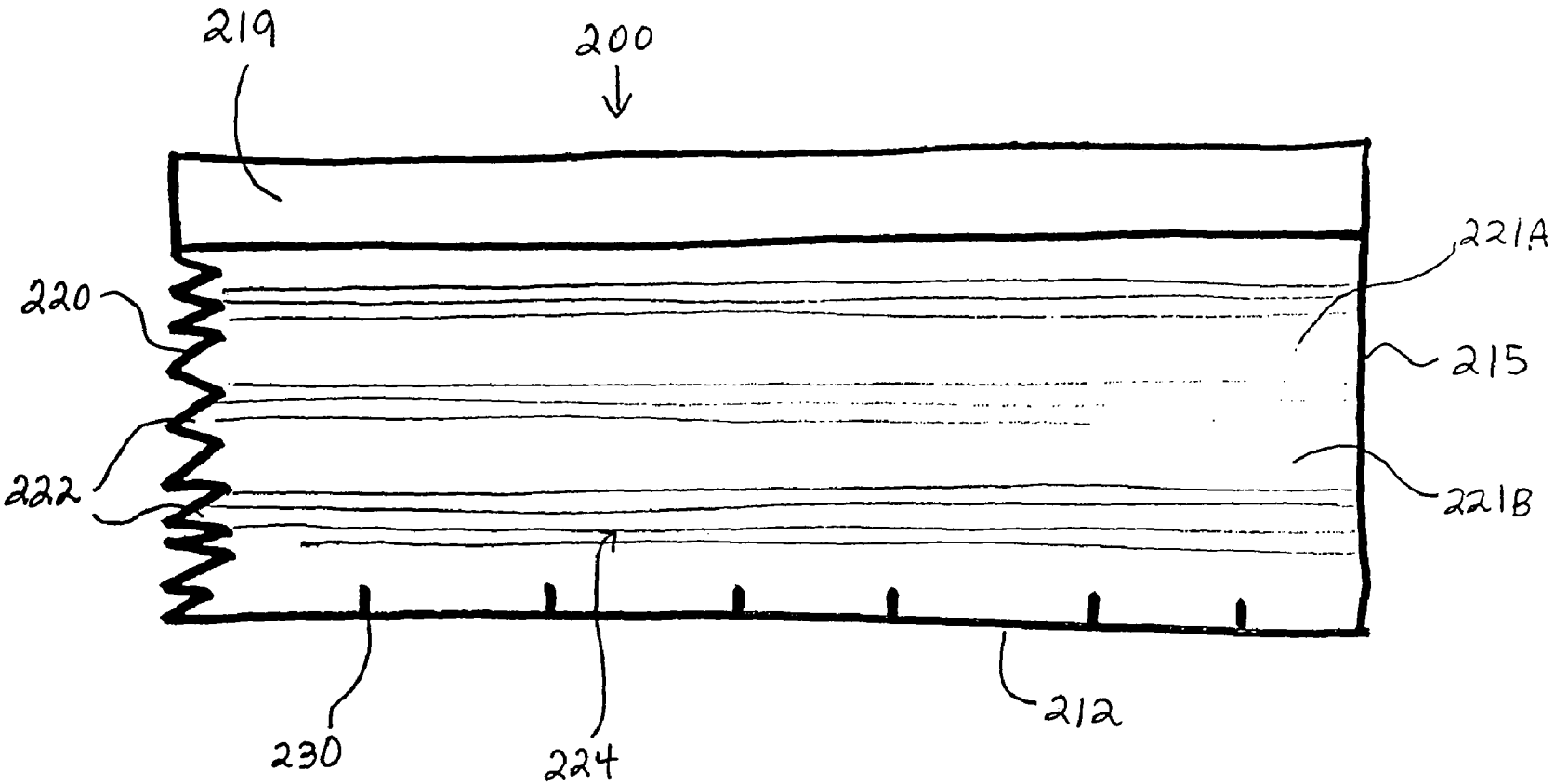
FIG. 9 is a top view of a further embodiment of the hand-held tool in accordance with the present invention.

FIG. 9 is a top view of the third embodiment of the present invention, which is also suited for removal or application of wallpaper. The member 200 comprises a wallpaper scraping edge 220 with teeth 222 formed therein, a flat scraping edge 212 for lifting and removing or smoothing down wallpaper, a scrubbing edge 215, and a handle 219 formed at the edge opposite the flat scraping edge 212. In this embodiment, undulations 221 formed in the member 200 are parallel to the flat scraping edge 212 and handle 219 and extend from the scrubbing edge 215 to the wallpaper scraping edge 220. Undulations 221 in the member 200 form peak regions 221A and valley regions 221B and impart flexibility to the tool. As shown, the length of the member 200 along the flat scraping edge 212 and handle 219 is greater than the width of the member 200 along the straight scrubbing edge 215 and wallpaper scraping edge 220. The flat scraping edge 212 may have hatch marks 230 for measuring or otherwise marking the surface with which the tool is used.

Figure 10:
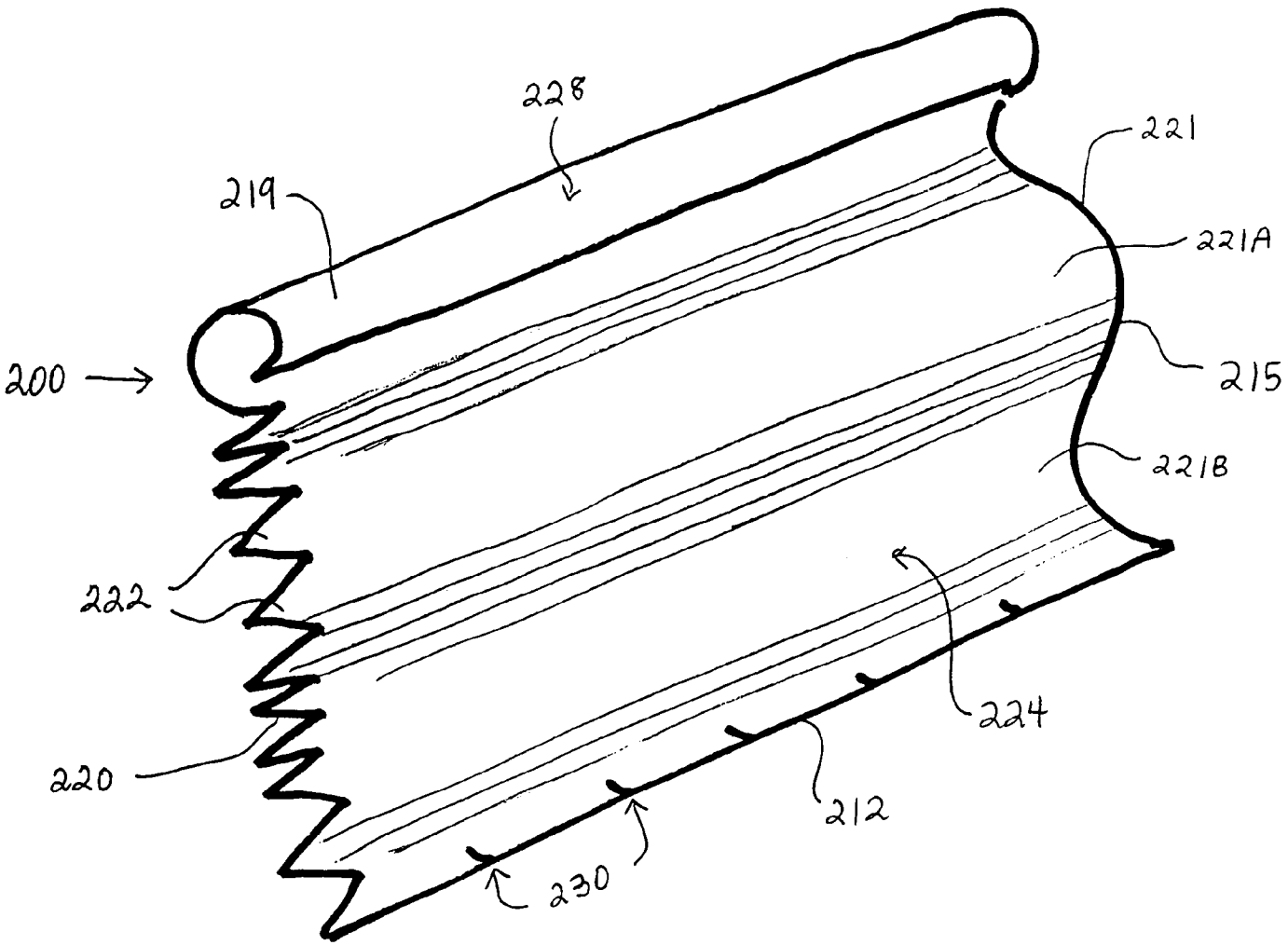
FIG. 10 is a perspective view thereof.

FIG. 10 is a perspective view of the third embodiment of FIG. 9. As shown in FIG. 10, the handle 219 formed along the edge of the member 200 opposite the flat scraping edge 212 is formed from a roll in the member that continues from the end of the last undulation 221 in the member 200 at that end.

In order to remove wallpaper or other particularly adhesive materials from a wall or other surface, a user may position his hand on the upper surface 224 of the member 200 so that his fingers are in the undulations 221 shown in FIG. 10. By controlling the pressure applied to the member, the user can remove the material with the wallpaper scraping edge 220 or with the scrubbing edge 215 easily and efficiently. On the other hand, if the user would like to lift a sheet of wallpaper from a wall or smooth a freshly applied sheet of wallpaper against the surface of the wall, or achieve any comparable task, he may grasp the handle 219 and use the flat scraping edge 212 by applying pressure to the member 200 accordingly.

Figure 11:
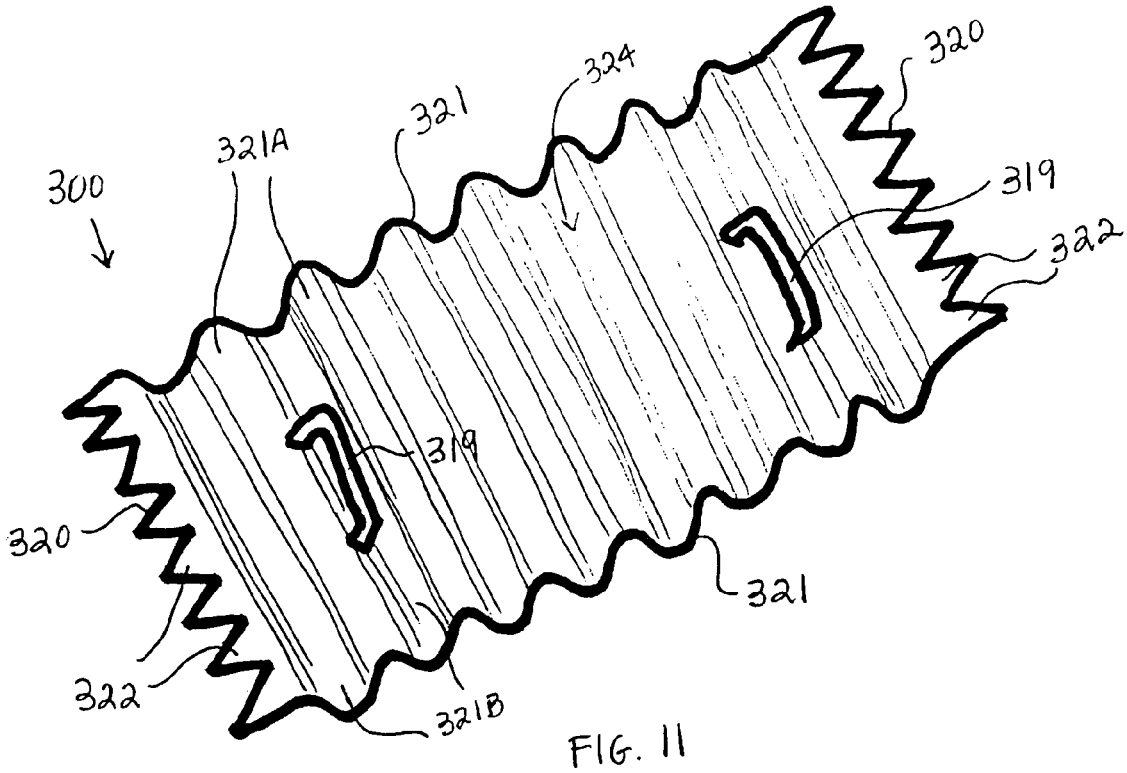
FIG. 11 is a perspective view of yet another embodiment of the hand-held tool in accordance with the present invention.
Figure 12:
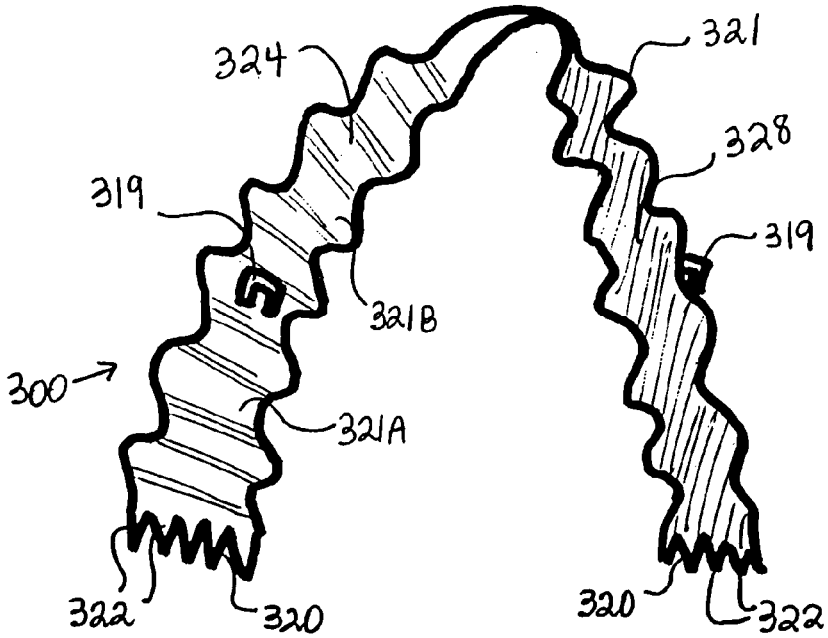
FIG. 12 is a perspective view of the embodiment of FIG. 11, shown in a bent form.

As has been noted with respect to other embodiments of the invention, flexibility of the tool member is greater when an edge of the tool is used which is parallel to the undulations formed in the member. In this respect, a further embodiment of the invention is shown in FIGS. 11 and 12.

In this embodiment of the invention, the tool member 300 has two opposite wallpaper scraping edges 320 with teeth 322. Undulations 321 formed in the member 300 are parallel to the scraping edges 320, forming numerous peak regions 321A. and valley regions 321B and imparting flexibility to the tool.

Two handles 319, preferably made of plastic, rubber, leather, or other durable material that is comfortable for the user to grip, are attached at two ends of the member 300 on an upper surface 324 thereof. The orientation of the scraping edges 320 parallel to the undulations 321 enables a user to grasp the handles 319 and bend the member 300 so that both scraping ends 320 may be used on the same surface at the same time, as shown in FIG. 12. The illustrative embodiment is further suited for use in light gardening tasks such as picking up piles of loose material, such as, for example, cut weeds, grass and branches, so that the user need not touch the material with his own hands.

In all cases it is understood that the above-described arrangements are merely illustrative of the many possible specific embodiments that represent applications of the present invention. Numerous and varied other arrangements can be readily devised in accordance with the principles of the present invention without departing from the spirit and scope of the invention.

What is claimed is:

1. A tool for performing multiple functions comprising:

a flexible member formed with a plurality of undulations; and a plurality of edges defined by a shape of said member and a curvature of said undulations, said plurality of edges comprising:

a straight edge parallel to said undulations;

a fingernail edge intersecting said straight edge at a first end, said fingernail edge having an S-shape and sinuous curvature;

a rounded edge parallel to said undulations, said rounded edge disposed on a side of said member opposite said straight edge and having an end continuous with a second end of said S-shape of said fingernail edge; and a further edge having a sinuous curvature disposed on a side of said member opposite said fingernail edge;

wherein said S-shape of said fingernail edge proceeds inwardly directly from said first end toward said further edge at an acute angle from said straight edge to a concave portion and then proceeds outwardly away from said further edge to a rounded convex portion, said rounded convex portion including a first rounded portion proceeding outwardly away from said further edge to a peak and a second rounded portion continuous with said first rounded portion, proceeding from said peak inwardly toward said further edge and then continuously to said second end of said fingernail edge;

wherein a sharp tip is formed by the intersection of said straight edge and said first end of said S-shape of said fingernail edge making an acute angle with said straight edge; and wherein said concave portion of said S-shape of said fingernail edge is in a first undulation and the rounded convex portion of said S-shape of said fingernail edge is in a second undulation of opposite direction to the first undulation and immediately following said first undulation.

2. A tool according to claim 1, wherein each of said straight edge and said rounded edge have a lip formed by an undulation.

3. A tool according to claim 2, wherein said member further comprises an upper surface and a lower surface, said lower surface having a roughened region disposed along an undulation.

4. A tool according to claim 3, wherein said rounded edge of said member is sharpened.

5. A tool according to claim 1, wherein:

said member has a thickness which varies so as to impart flexibility.

6. A tool according to claim 1, wherein:

said undulations include valley portions and peak portions and wherein the thickness of said valley portions is greater than the thickness of said peak portions.

7. A tool according to claim 1, wherein said further edge appears straight when projected onto a plane situated in a facing relationship with said undulations of said flexible member.

8. A tool according to claim 1, wherein a part of said fingernail edge from an end of said second rounded portion to said second end of said fingernail edge is in a third undulation of opposite direction to said second undulation and immediately following said second undulation.

9. A tool according to claim 8, wherein the rounded edge is at an end of a first partial undulation of opposite direction to said third undulation and immediately following said third undulation.

10. A tool according to claim 9, wherein said first partial undulation is such that said rounded edge forms a lip.

11. A tool according to claim 1, wherein said straight edge is at an end of a second partial undulation of opposite direction to the first undulation and immediately preceding the first undulation.

* * * * *